US007855686B2

(12) United States Patent
Chen et al.

(10) Patent No.: US 7,855,686 B2
(45) Date of Patent: Dec. 21, 2010

(54) COMPACT ANTENNAS FOR ULTRA-WIDEBAND APPLICATIONS

(75) Inventors: Zhining Chen, Singapore (SG); Shie Ping Terence See, Singapore (SG)

(73) Assignee: Agency for Science, Technology and Research, Singapore (SG)

( * ) Notice: Subject to any disclaimer, the term of this patent is extended or adjusted under 35 U.S.C. 154(b) by 145 days.

(21) Appl. No.: 12/063,992

(22) PCT Filed: Aug. 17, 2005

(86) PCT No.: PCT/SG2005/000282

§ 371 (c)(1),
(2), (4) Date: Jun. 11, 2008

(87) PCT Pub. No.: WO2007/021247

PCT Pub. Date: Feb. 22, 2007

(65) Prior Publication Data

US 2008/0316108 A1 Dec. 25, 2008

(51) Int. Cl.
*H01Q 1/24* (2006.01)

(52) U.S. Cl. ..... 343/700 MS; 343/846

(58) Field of Classification Search ..... 343/700 MS, 343/829, 846

See application file for complete search history.

(56) References Cited

U.S. PATENT DOCUMENTS

| | | | | |
|---|---|---|---|---|
| 6,535,166 | B1 * | 3/2003 | Ali | 343/700 MS |
| 6,798,383 | B2 * | 9/2004 | Nakase et al. | 343/700 MS |
| 6,914,565 | B2 * | 7/2005 | Shikata et al. | 343/700 MS |
| 7,176,843 | B2 * | 2/2007 | Shimasaki et al. | 343/795 |
| 7,405,664 | B2 * | 7/2008 | Sakama et al. | 340/572.7 |
| 2007/0120740 | A1 * | 5/2007 | Iellici et al. | 343/700 MS |

* cited by examiner

*Primary Examiner*—Tho G Phan
(74) *Attorney, Agent, or Firm*—McDonnell Boehnen Hulbert & Berghoff LLP

(57) ABSTRACT

The antenna (100) has a radiating element (104) for transmitting and receiving signals. The radiating element (104) comprises a first portion (110), a second portion (112) and a notch (114). The notch (114) extends from a portion o the periphery of the radiating element into the radiating element and is for substantially segregating the radiating element into the first portion (110) and the second portion (112). The radiating element (104) also has an interconnecting portion (108) for structurally interconnecting the first portion and the second portion. The interconnecting portion is formed substantially distal to the portion of the periphery of the radiating element. In addition, the antenna (100) has a first arm (116) that extends from the first portion of the radiating element for modifying the operating frequency range of the antenna.

26 Claims, 7 Drawing Sheets

COMPACT ANTENNAS FOR ULTRA-WIDEBAND APPLICATIONS

FIELD OF INVENTION

The invention relates generally to antennas. In particular, it relates to compact planar antennas for ultra-wideband applications.

BACKGROUND

The use of ultra-wideband (UWB) technology is becoming increasingly popular in wireless communication systems. Radio systems that employ UWB technology have very wide operating bandwidth. This means that a much wider operating frequency range is advantageously available to UWB radio systems than conventional narrow-band radio systems. This distinctive feature of the UWB radio systems has prompted the US Federal Communication Commission (FCC) to regulate the operating frequency range of the UWB radio systems to between 3.1 and 10.6 GHz, with an effective isotropic radiated power (EIRP) not exceeding ~41.3 dBm/MHz. The regulation limits the radiated power levels and signal spectra of the UWB radio systems in order to avoid interference to the conventional narrow-band radio systems which occupy a part of the frequency spectrum of the UWB radio systems.

Antennas for UWB radio systems need to be designed to fulfill a number of additional requirements. Firstly, the antennas need to have a bandwidth that is as broad and well-matched as possible for achieving broadband capability and attaining high radiation efficiency. Secondly, the antennas need to have a linear phase response for minimising distortion of signals which are transmitted through the antennas. Thirdly, the antennas need to radiate signals with maximum power in a desired direction.

With advancement in circuit integration and functionality, modern wireless communication devices, such as portable UWB DVD player and sensors, have become dimensionally smaller. The dimensions of the antennas have consequently become proportionally larger when compared to the overall dimensions of the UWB radio systems. Therefore, in conjunction with the abovementioned requirements for the UWB radio systems, a fourth requirement for designing UWB antennas is to reduce the dimensions of the antennas while still satisfying the other three requirements.

Numerous attempts have been made to fulfill the four requirements through various designs of antennas for the UWB radio system. More notable examples are transverse electromagnetic mode (TEM) horns and self-supplemental antennas, such as spiral antennas. Both types of antennas feature very broad and well-matched bandwidths. However, signals generated by both types of antennas are distorted and suffer from dispersion due to frequency-dependant changes in their respective phase centers.

Bi-conical and disk-conical antennas have less distortion and have relatively stable phase centers for achieving a broad and well-matched bandwidth. This is because resistive loadings are used to eliminate reflection of radiated pulses occurring at transmission ends of both antennas. However, both antennas are bulky in size and are thus unsuitable for the portable UWB devices.

Further attempts have been made to reduce the dimensions of UWB antennas by forming the antennas on printed circuit boards (PCBs). These attempts, however, have produced antennas which require a large ground plane for operation. The use of the large ground plane causes the operation of the antennas to be susceptible to changes in grounding conditions. This can substantially affect the operational stability of the antennas.

In U.S. Pat. No. 6,512,488, Schantz proposes a planar monopole antenna having a circular shape. The monopole antenna forms a parasitic open-grounded loop during operation to achieve broadband characteristics. However, the monopole antenna requires a ground plane for which operational stability can be substantially affected by changes to grounding conditions.

In U.S. Pat. Nos. 5,627,550 and 5,680,144, planar antennas having rectangular and triangular notches are proposed by Sanad for size reduction. However, the planar antennas are similarly susceptible to variable grounding conditions and the bandwidth of the monopole is also not sufficiently broad for UWB applications.

There is therefore a need for a UWB antenna which is dimensionally small and substantially independent of grounding conditions for use in small portable UWB devices.

SUMMARY

Embodiments of the invention are disclosed hereinafter for ultra-wideband (UWB) applications having a small dimensional size and being substantially independent of grounding conditions for use in small portable UWB devices.

In accordance with one aspect of the invention, there is disclosed an antenna formable on at least a first surface of a substrate for ultra-wideband applications. The antenna has a radiating element for transmitting and receiving signals. The radiating element comprises a first portion, a second portion and a notch. The notch extends from a portion of the periphery of the radiating element into the radiating element and is for substantially segregating the radiating element into the first portion and the second portion. The radiating element also has an interconnecting portion for structurally interconnecting the first portion and the second portion. The interconnecting portion is formed substantially distal to the portion of the periphery of the radiating element. In addition, the antenna has a first arm that extends from the first portion of the radiating element for modifying the operating frequency range of the antenna.

In accordance with another aspect of the invention, there is disclosed a method for configuring an antenna formed on at least a first surface of a substrate for UWB applications. The method involves an initial step of providing a radiating element that comprises a first portion, a second portion and a notch for transmitting and receiving signals. The notch is extended from a portion of the periphery of the radiating element into the radiating element and is for substantially segregating the radiating element into the first portion and the second portion. An interconnecting portion is then formed distal to the portion of the periphery of the radiating element for structurally interconnecting the first portion and the second portion. The method then involves the step of providing a first arm that extends from the first portion of the radiating element for modifying the operating frequency range of the antenna.

BRIEF DESCRIPTION OF DRAWINGS

Embodiments of the invention are described in detail hereinafter with reference to the drawings, in which.

DETAILED DESCRIPTION

Figure 1A:
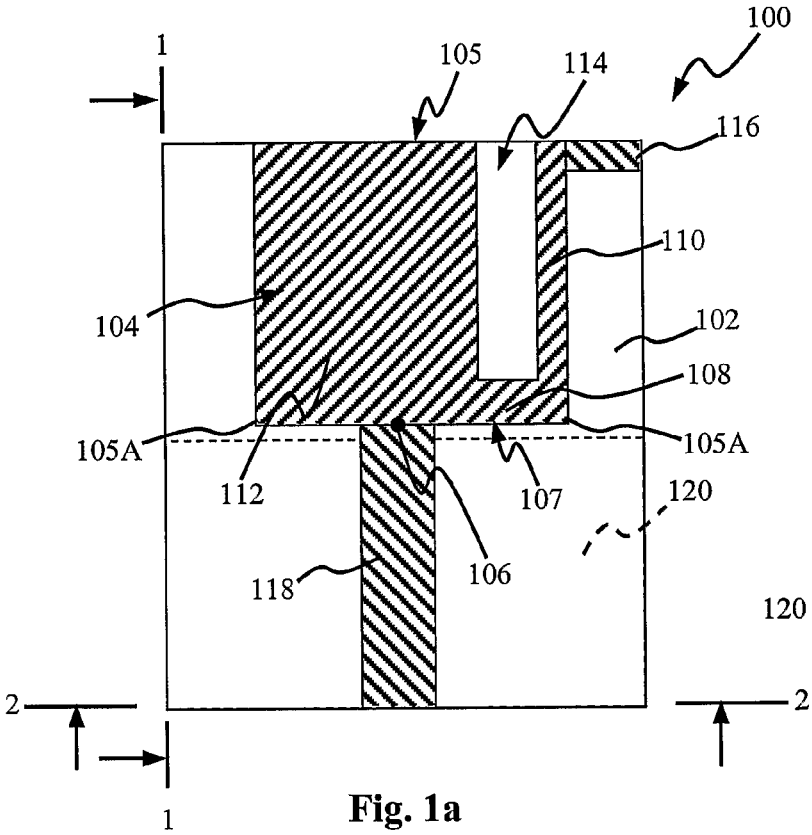
FIGS. 1*a* to 1*e* are schematic views of an antenna according to a first embodiment of the invention.

With reference to the drawings, antennas that are dimensionally small and substantially ground independent for ultra-wideband (UWB) applications according to embodiments of the invention are disclosed for facilitating miniaturization of portable UWB devices.

Various conventional UWB antennas have been previously proposed. Some of these conventional UWB antennas are however not suitable for use in small portable UWB devices. Other conventional UWB antennas require ground planes for operation and are susceptible to changes in grounding conditions, which can substantially affect the operational stability of the antennas.

For purposes of brevity and clarity, the description of the invention is limited hereinafter to UWB applications. This, however, does not preclude embodiments of the invention from other applications that require similar operating performance as the UWB applications. The functional principles fundamental to the embodiments of the invention remain the same throughout the various embodiments.

Embodiments of the invention are described in greater detail in accordance with FIGS. 1*a* to 1*e* and 2*a* to 2*e* of the drawings hereinafter, wherein like elements are identified with like reference numerals.

Figure 1B:
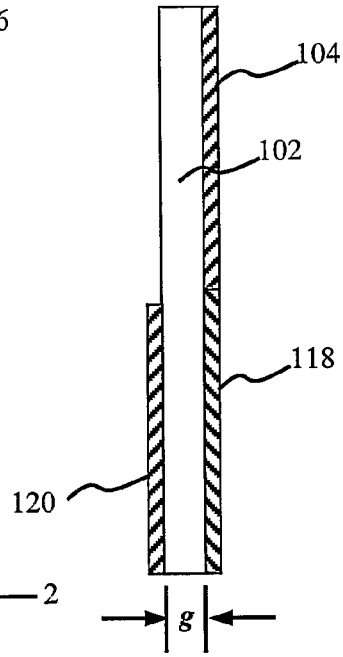
Figure 1C:
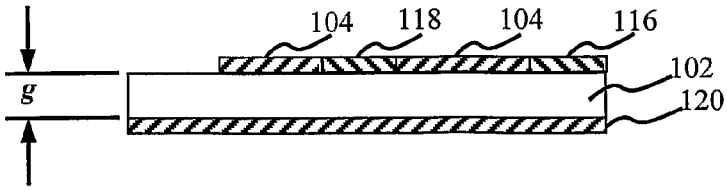
Figure 1D:
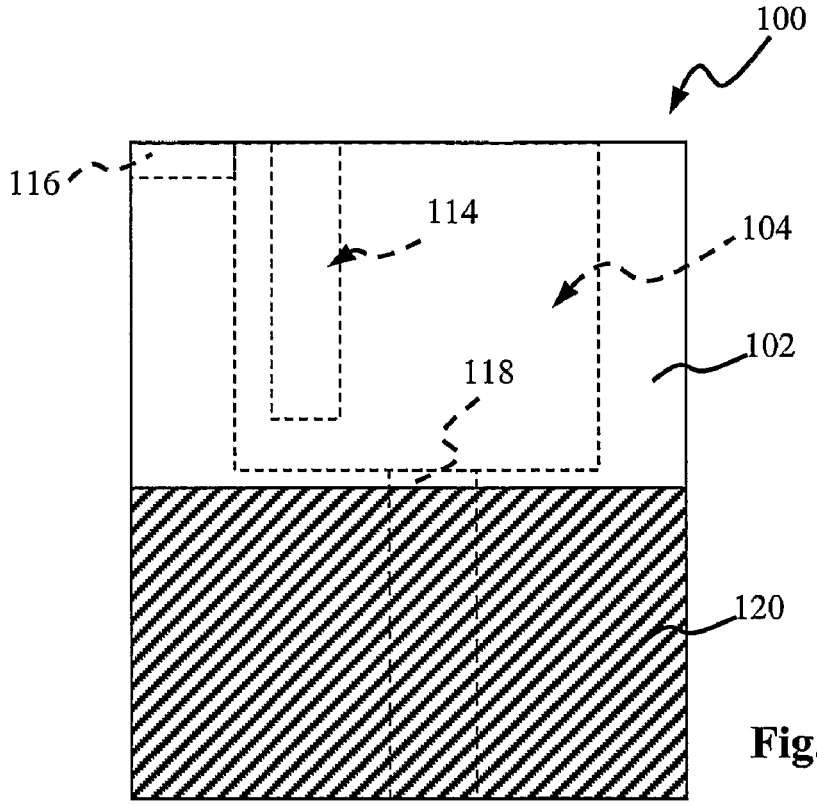

FIGS. 1*a* to 1*e* show the geometry of an antenna 100 according to a first embodiment of the invention. The antenna 100 is dimensionally small for use in small portable UWB applications that require a compact design. FIG. 1*a* is a plan view of the antenna 100. FIG. 1*b* is a side view of the antenna 100 along line 1-1. FIG. 1*c* is a bottom view of antenna 100 along line 2-2 and FIG. 1*d* is a back view of the antenna 100. The antenna 100 is preferably formed monolithically on a first surface and adjacent to a top edge of a substrate 102, such as a printed circuit board (PCB). The antenna 100 has a radiating element 104 for transmitting and receiving signals to and from another antenna.

The radiating element 104 is geometrically shaped and preferably plate-like. In this first embodiment of the invention, the radiating element 104 is formed in the shape of a rectangle having a top edge 105 and has an planar surface. In a first exemplary design, the radiating element 104 is formed on a non-planar surface, such as a corrugated surface or other curved surfaces. In a second exemplary design, the radiating element 104 is itself non-planar and is curved or corrugated. The radiating element 104 in the second exemplary design is therefore a stand-alone plate-like structure that is preferably perpendicularly attached to the substrate 102. In the first and second exemplary designs of the radiating element 104, at least one of the lower corners 105A of the radiating element 104 can be cut to form a bevel for impedance matching purposes.

The radiating element 104 has a feeding point 106 for transmitting and receiving signals. The feeding point 106 is located at a predetermined position on the planar surface of the radiating element 104. The feeding point 106 is preferably positioned along a bottom edge 107 that is opposite to the top edge 105 of the radiating element 104, according to the first embodiment of the invention. The radiating element 104 has a notch 114 or slot formed therein. The notch 114 extends from a portion of the periphery of the radiating element 104, such as the top edge 105, and into the radiating element 104, wherein the periphery of the radiating element 104 can be of any shape. The notch 114 is therefore open-ended along the top edge 105 of the radiating element 104 and is for substantially segregating the radiating element 104 into a first potion 110 and a second portion 112. The notch 114 is geometrically shaped and is preferably substantially elongated. An interconnecting portion 108 structurally interconnects the first portion 110 and the second portion 112 and is substantially formed distal to the periphery portion of the radiating element 104.

The antenna 100 further comprises a first arm 116 extending substantially outwardly from the first portion 110 of the radiating element 104. The first arm 116 is preferably but not limited to having a rectangular shape. Additionally, the first arm 116 is preferably located along a first side of the radiating element 104 opposite line 1-1 and substantially proximal to the portion of the periphery of the radiating element 104 wherefrom the notch 114 extends.

The notch 114 and the first arm 116 of the radiating element 104 advantageously created an electrical current path through which signals having UWB bandwidths travel. The operating frequency bandwidth and impedance response characteristics of the antenna are modifiable by respectively varying the dimensions and positions of the notch 114 and the first arm 116 of the radiating element 104.

A connecting feed strip or connector 118, as shown in FIG. 1*a*, extends outwardly from the bottom edge 105 of the radiating element 104. The connector 118 is geometrically shaped and is preferably elongated and has a length that is dependent on the dimensions of the substrate 102 and the radiating element 104. The radiating element 104, the first arm 116, and the connector 118 are preferably formed on the first surface of the substrate 102.

Figure 1E:
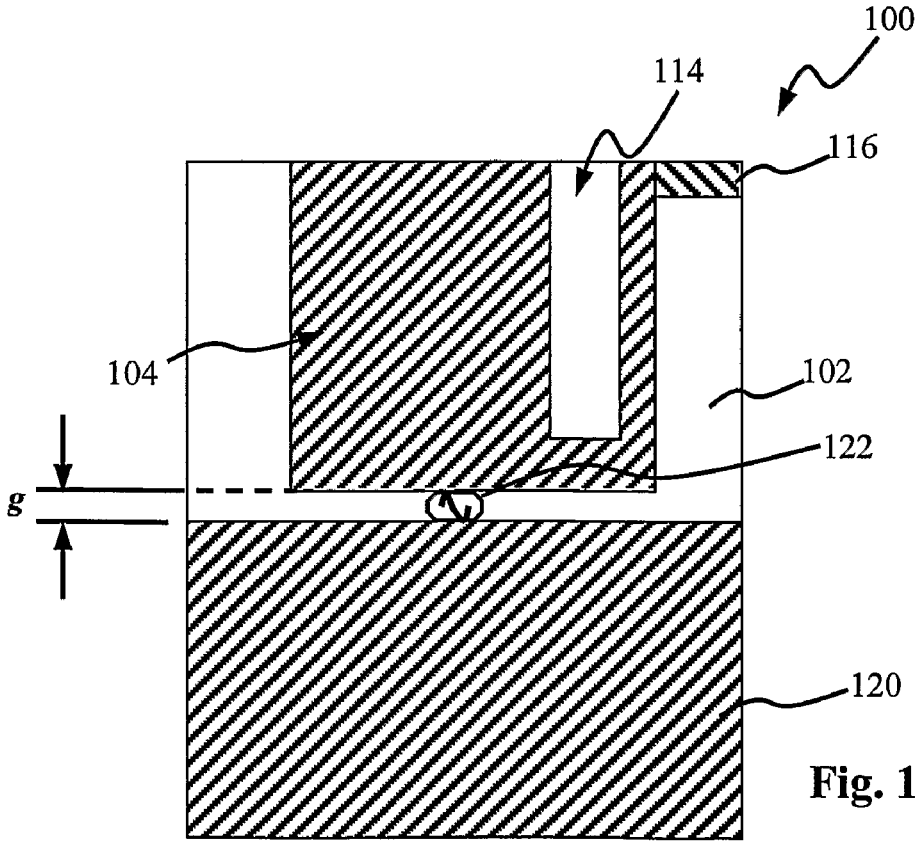

The connector 118 is preferably configured for facilitating connection of the radiating element 104 to a feed 122 (shown in FIG. 1*e*). The position of the feeding point 106 and connector 118 can be varied for improving the impedance matching of the antenna 100. The feed 122 is preferably connected at one terminal to the connector 118 and the other terminal to the ground plane 120 for transmitting and receiving the signals. The ground plane 120 is preferably formed on a second surface of the substrate 102. The second surface is outwardly opposite to the first surface of the substrate 102. The ground plane 120 is preferably but not limited to having a rectangular shape.

As shown in FIGS. 1*b* and 1*e*, a feed-gap g is formed between the radiating element 104 and the ground plane 120. The operating frequency bandwidth and impedance response characteristics of the antenna 100 are, in addition to the dimensions and positions of the notch 114 and the first arm 116, modifiable by respectively varying the position of the feeding point 106 and the dimensions of the feed-gap g. The feed-gap g is therefore variable and is dependent on design requirements.

Alternatively, as shown in FIG. 1*e*, the ground plane 120 is formed on the same first surface of the substrate 120 as the radiating element 104 and the first arm 116, in which the connector 118 is absent. The feed 122 is then preferably connected at one terminal to the connector 118 and the other terminal to the ground plane 120.

Figure 2A:
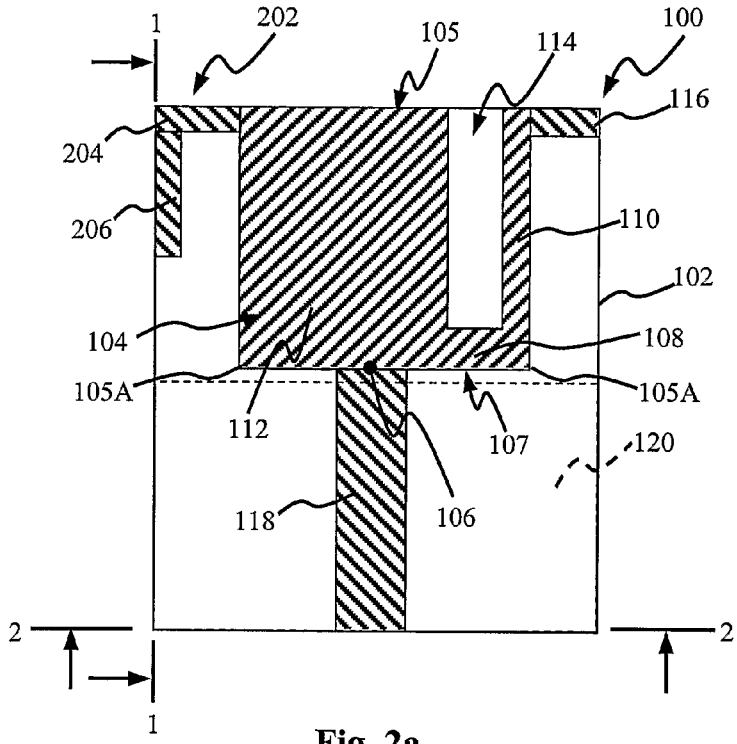
FIGS. 2*a* to 2*e* are schematic views of the antenna of FIGS. 1*a* to 1*e* according to a second embodiment of the invention.
Figure 2B:
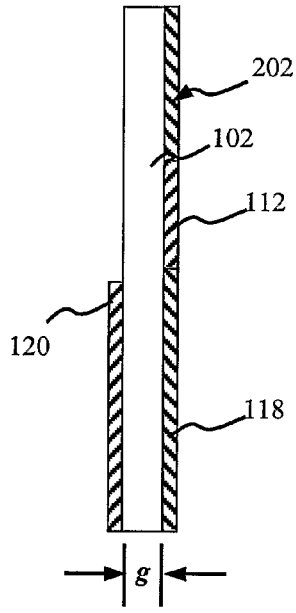
Figure 2C:
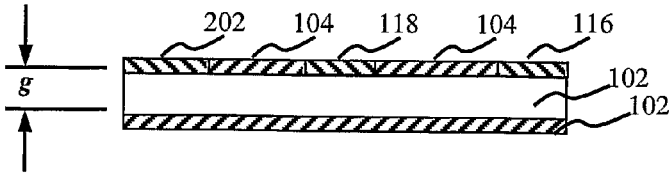
Figure 2D:
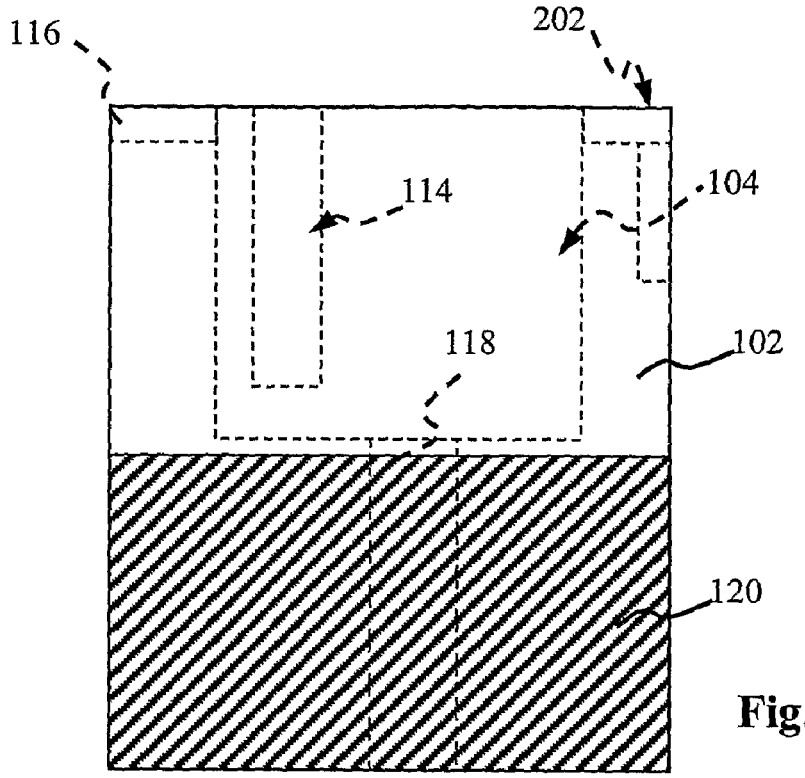

FIGS. 2*a* to 2*e* show a second embodiment of the invention, in which the antenna 100 is structurally similar to the first embodiment of the invention and comprises the radiating element 104 having the notch 114, the first arm 116, the connector 118, and the ground plane 120. The radiating element 104 is separated from the ground plane 120 by the feed-gap g. FIG. 2*a* is a plan view of the antenna 100. FIG. 2*b* is a side view of the antenna 100 along line 1-1. FIG. 2*c* is a bottom view of antenna 100 along line 2-2 and FIG. 2*d* is a back view of the antenna 100.

An additional second arm 202 extends substantially outwardly from the second portion 112 of the radiating element 104. The second arm 202 is preferably but not limited to having an L shape. The second arm 202 is preferably formed along a second side of the radiating element 104 parallel to line 1-1 and extends outwardly opposite the first arm 116. The second arm 202 preferably has a first section 204 and a second section 206. The first section 204 has one end that is connected to the second portion 112 of the radiating element 104. The second section 206 is connected along the first section 204 and preferably distal to the second portion 112 of the radiating element 104.

In this second embodiment of the invention, the second section 206 of the second arm 202 is preferably perpendicular to the first section 204 thereof and preferably extends towards the bottom edge 107 of the radiating element 104. The second arm 202 is configured as such so that the operating frequency range of the antenna 100 is broader than that of the first embodiment of the invention. The radiating element 104, the first and second arm 116, 202, and the connector 118 are preferably coplanar and are formed on the first side of the substrate 102.

Figure 2E:
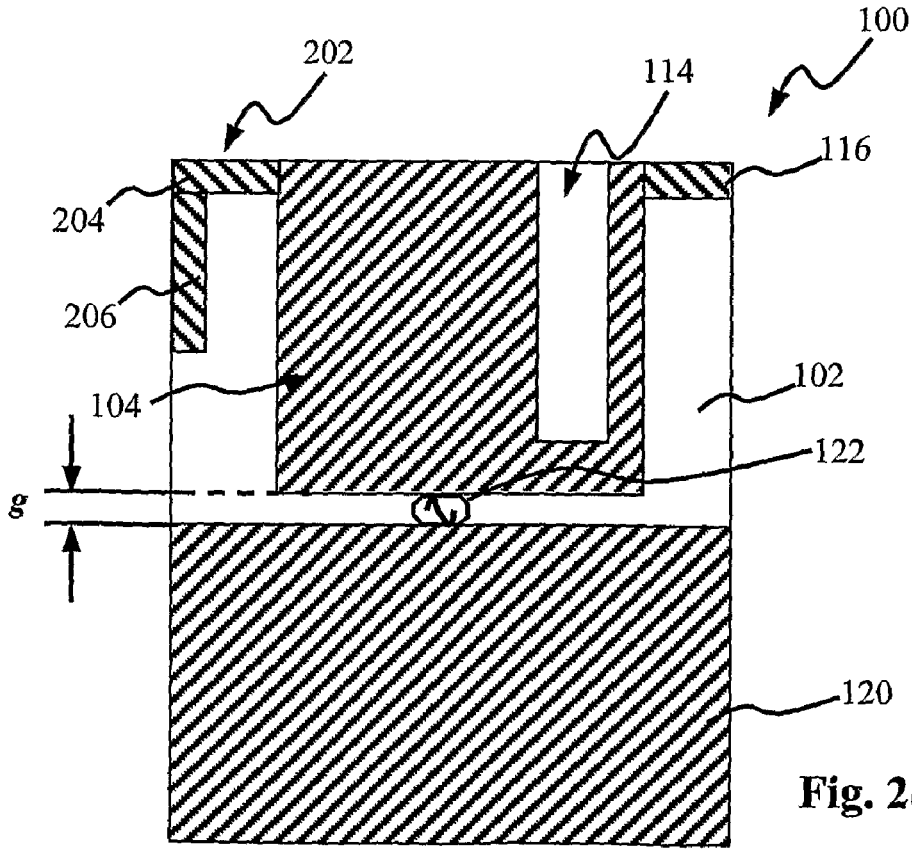

Alternatively, as shown in FIG. 2*e*, the ground plane 120 in the second embodiment of the invention is formed on the same first surface of the substrate 120 as the radiating element 104 and the first and second arm 116, 202, in which the connector 118 is absent. The radiating element 104 is then connected to one terminal of the feed 122 via the feeding point 106. The other terminal of the feed 122 is connected to the ground plane 120.

The antenna 100 as described in the second embodiment of the invention performs the same functionality and has similar impedance matching and transfer function characteristics as the first embodiment of the invention. The dimensions of the radiating element 104 with the first and second arms 116, 202, the connector 118 and the ground plane 120 are dependent on design requirements, as well as the thickness and material type of the substrate 102. The antenna 100 is preferably made of conductive material such as copper.

Figure 3:
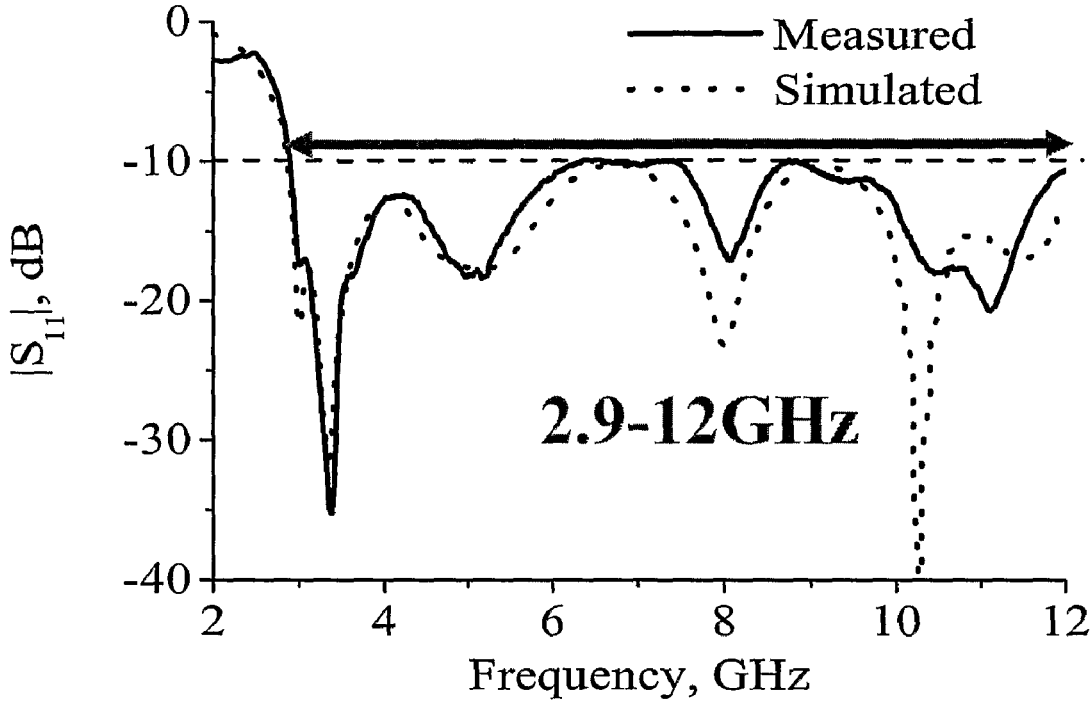
FIG. 3 is a graph showing measured and simulated results of the impedance matching characteristics of the antenna 100 of FIG. 1*a*.

FIG. 3 is a graph showing measured and simulated results of the impedance matching of the antenna 100 of FIG. 1*a* are in good agreement. The impedance matching frequency response of the antenna 100 is represented by $|S_{11}|$. The measured and simulated results show the antenna 100 having a well-matched impedance matching characteristic throughout the frequency range of 2.9 to 12 GHz and achieving good return loss $|S_{11}|$ over the same frequency range.

Additionally, both the measured and simulated results showed a UWB impedance bandwidth with a frequency range of approximately 2.9 to 12 GHz for a return loss of less than −10 dB. The simulated results are obtained without any transmission structure. The measured results are obtained with a radio frequency (RF) coaxial cable. This suggests that the antenna 100 according to the first embodiment of the present invention is considerably unaffected by the changes in grounding conditions introduced by the transmission structure or coaxial cable and is therefore advantageously substantially independent of grounding conditions.

Figure 4A:
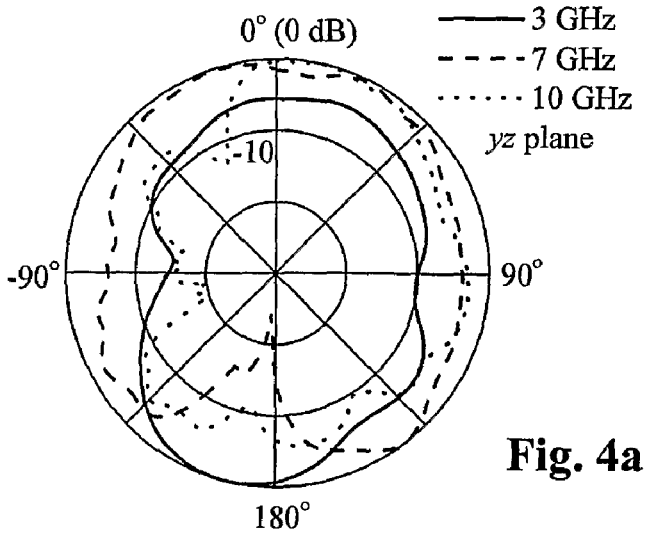
FIGS. 4*a* to 4*c* are graphs showing measured radiation patterns across the bandwidth of the antenna of FIG. 1*a* over three main planes.
Figure 4B:
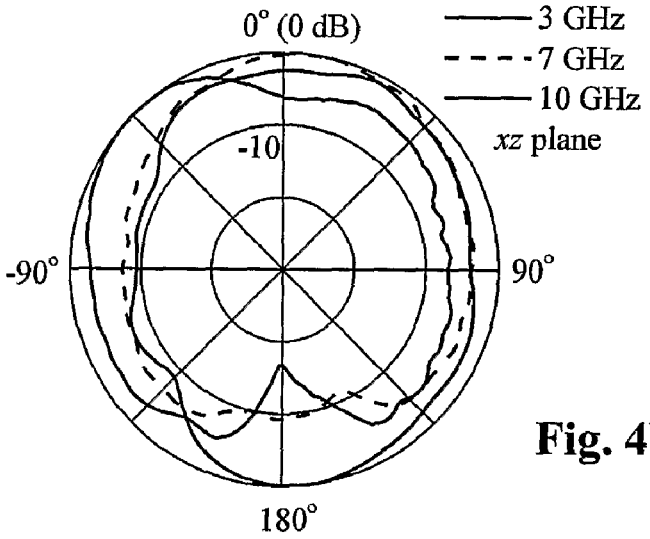
Figure 4C:
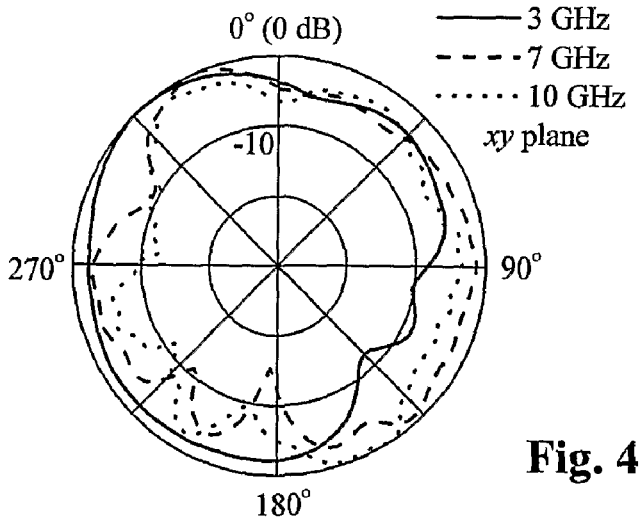
Figure 5A:
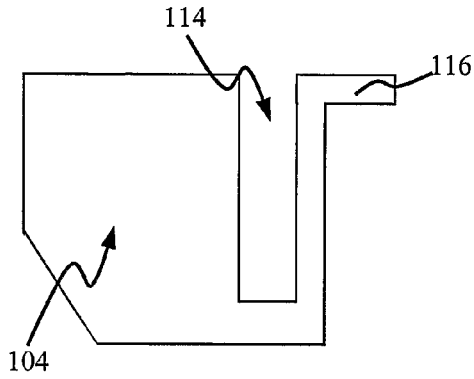
FIGS. 5*a* to 5*f* are schematic illustrations of antenna embodiments in accordance with the invention which have radiating elements constructed in various geometrical forms such as ellipses, triangles, polygons, or annuli.
Figure 5B:
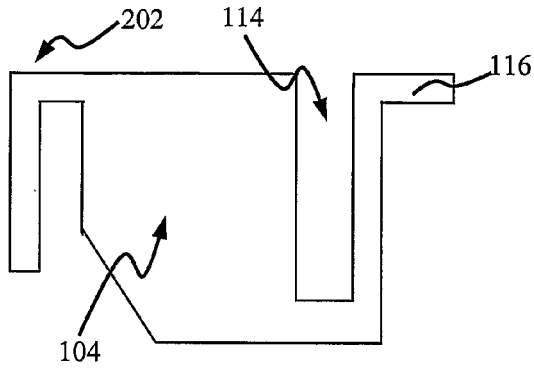
Figure 5C:
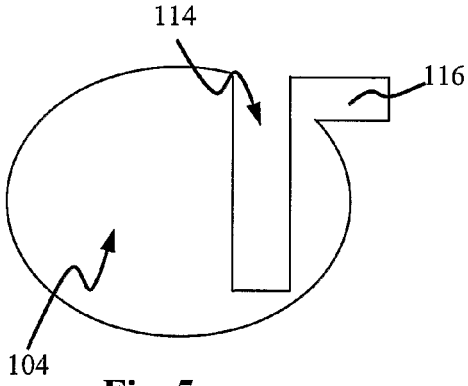
Figure 5D:
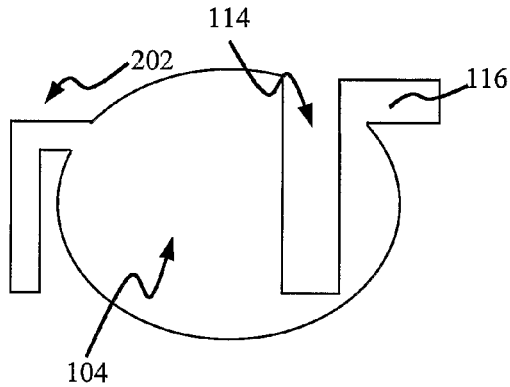
Figure 5E:
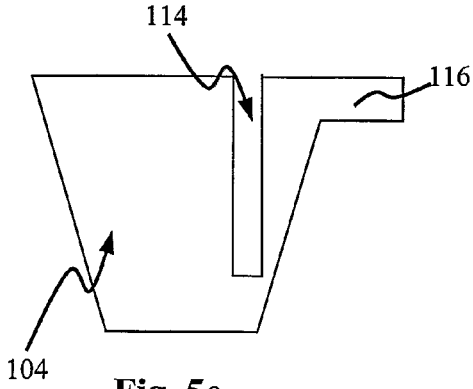
Figure 5F:
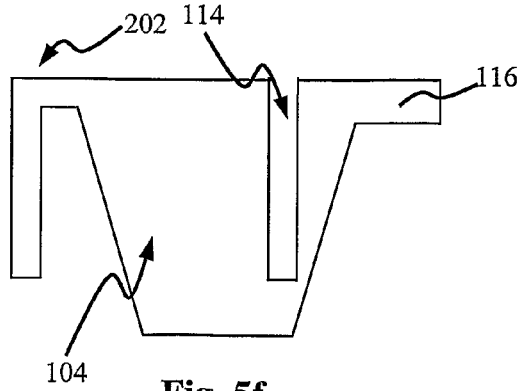

FIGS. 4*a* to 4*c* shows measured radiation patterns of the antenna 100 of FIG. 1*a* across three main planes, namely the y-z plane of FIG. 4*a*, the x-z plane of FIG. 4*b*, and the x-y plane of FIG. 4*c*. The radiation patterns across each of the three main planes are measured at three different frequencies, namely 3, 7, and 10 GHz. The results show stable radiation performance of the antenna 100 across the UWB bandwidth. The maximum average gain of the antenna 100 measured across the three main planes is greater than 2.6 dBi while the measured average gain across the three main planes varies from −2.3 dBi to 2.6 dBi. The gain of the antenna 100 is therefore sufficiently high for most mobile communication applications.

The various embodiments of the invention may be applied advantageously to portable UWB systems that require sufficient gain and small dimensions for device miniaturization.

In the foregoing manner, an antenna having notch for UWB applications is disclosed. Although only a number of embodiments of the invention are disclosed, it becomes apparent to one skilled in the art in view of this disclosure that numerous changes and/or modifications can be made without departing from the scope and spirit of the invention. For example, as shown in FIGS. 5*a* to 5*f*, the radiating elements according to the first and second embodiments of the invention may be constructed from conductive materials in other geometrical forms, such as ellipses, triangles, polygons or annuli.

The invention claimed is:

1. An antenna formable on at least a first surface of a substrate for ultra-wideband applications, the antenna comprising:

a radiating element for transmitting and receiving signals, the radiating element comprising:

a first portion having a first surface area;

a second portion having a second surface area substantially larger than the first surface area;

a notch having an opening at a periphery of the radiating element and extending into the radiating element, the notch substantially segregating the radiating element into the first portion and the second portion;

an interconnecting portion for structurally interconnecting the first portion and the second portion and formed substantially distal to the portion of the periphery of the radiating element at which the opening of the notch resides; and a first arm proximate to the opening of the notch and extending away from the first portion of the radiating element in a direction transverse to an elongate border of the first portion of the radiating element, the first arm for modifying the operating frequency range of the antenna.

2. The antenna of claim 1, wherein the first arm includes a border along a first arm length that is substantially parallel to the opening of the notch.

3. The antenna of claim 1, wherein the notch is substantially elongated.

4. The antenna of claim 3, wherein the notch exhibits a geometrically uniform profile between the notch opening and a boundary of the notch distal to the notch opening.

5. The antenna of claim 1, wherein the radiating element is corrugated.

6. The antenna of claim 1, further comprising a second arm extending from the second portion of the radiating element.

7. The antenna of claim 6, wherein the second arm extends substantially outwardly from the second portion of the radiating element in a direction away from the notch and the first portion of the radiating element.

8. The antenna of claim 6, wherein the second arm has a first section and a second section, one end of the first section connected to the second portion of the radiating element and another end of the first section connected to the second section.

9. The antenna of claim 8, wherein the second section of the second arm is substantially perpendicular to the first section of the second arm.

10. The antenna of claim 8, wherein the second section of the second arm extends in a direction substantially perpendicular to the opening of the notch.

11. The antenna of claim 6, wherein the radiating element, the first arm and the second arm are formed on the first surface of the substrate.

12. The antenna of claim 6, wherein the second arm includes a segment that transversely extends away from the second portion of the radiating element in a direction opposite to a direction in which the first arm transversely extends away from the elongate border of the first portion of the radiating element.

13. The antenna of claim 1, wherein a ground plane is electrically coupled to the radiating element and is formed on at least one of the first surface and a second surface of the substrate, the second surface of the substrate being opposite to the first surface thereof.

14. The antenna of claim 13, wherein a connector extends from the radiating element, the connector being configurable for facilitating the connection of the radiating element to a feed.

15. The antenna of claim 14, wherein the connector extends substantially outwardly from a portion of the periphery of the radiating element proximal to the interconnecting portion of the radiating element.

16. The antenna of claim 13, wherein the ground plane is coplanar with the radiating element.

17. The antenna of claim 13, wherein the radiating element is connected to the ground plane via a feed.

18. The antenna of claim 1, wherein the first arm has a surface area that is substantially smaller than the first surface area.

19. The antenna of claim 1, wherein the interconnecting portion has a surface area that is substantially smaller than the first surface area.

20. A method for configuring an antenna formable on at least a first surface of a substrate for ultra-wideband applications, the method comprising the steps of:

providing a radiating element for transmitting and receiving signals, the radiating element comprising:

a first portion having a first surface area;

a second portion having a second surface area substantially larger than the first surface area;

a notch having an opening at a periphery of the radiating element and extending into the radiating element, the notch substantially segregating the radiating element into the first portion and the second portion;

an interconnecting portion for structurally interconnecting the first portion and the second portion and formed substantially distal to the portion of the periphery of the radiating element at which the opening of the notch resides; and providing a first arm proximate to the opening of the notch and extending away from the first portion of the radiating element in a direction transverse to an elongate border of the first portion of the radiating element, the first arm for modifying the operating frequency range of the antenna.

21. The method of claim 20, further comprising the step of:

providing a second arm extending substantially outwardly from the second portion of the radiating element.

22. The method of claim 21, wherein the radiating element and the ground plane are connected via one of a connector and a feed.

23. The method of claim 21, wherein the antenna is unitary.

24. The method of claim 20, further comprising the step of:

providing a ground plane formed on at least one of the first surface and a second surface of the substrate.

25. The method of claim 20, wherein the first arm has a surface area that is substantially smaller than the first surface area.

26. The method of claim 20, wherein the interconnecting portion has a surface area that is substantially smaller than the first surface area.

* * * * *